US005527190A

United States Patent [19]

Weingartner

[11] Patent Number: 5,527,190

[45] Date of Patent: Jun. 18, 1996

[54] JACK PLUG

[75] Inventor: Bernhard Weingartner, Feldkirch, Austria

[73] Assignee: Neutrik Aktiengesellschaft, Schaan, Liechtenstein

[21] Appl. No.: 419,385

[22] Filed: Apr. 10, 1995

[30] Foreign Application Priority Data

Apr. 22, 1994 [DE] Germany ..... 44 14 012.6

[51] Int. Cl.[6] ..... H01R 17/18; H01R 13/58

[52] U.S. Cl. ..... 439/669; 439/462

[58] Field of Search ..... 439/462, 461, 439/669, 289, 468, 668, 696, 701

[56] References Cited

U.S. PATENT DOCUMENTS

| | | | |
|---|---|---|---|
| 2,238,834 | 4/1941 | Travers | 439/669 X |
| 4,191,443 | 3/1980 | Doyle | 439/462 |
| 5,180,317 | 1/1993 | Franks, Jr. | 439/669 |
| 5,219,304 | 6/1993 | Lin | 439/461 |
| 5,261,839 | 11/1993 | Franks, Jr. | 439/669 |
| 5,336,108 | 8/1994 | Lin | 439/462 |

*Primary Examiner*—Jes F. Pascua

*Attorney, Agent, or Firm*—McAulay Fisher Nissen Goldberg & Kiel

[57] ABSTRACT

A jack plug has a plug housing formed by two shells and a cable bushing which can be screwed on a thread provided at the plug housing and penetrated by the cable to be connected. The outer contact shaft is formed integral with one shell of the plug housing, which shell is formed of metallic material. The outer contact shaft or its longitudinal axis is disposed at right angles to the dividing plane of the plug housing. A cylindrical neck which has the thread and is substantially closed circumferentially is provided at the end of one shell. A hook-like abutment is formed on at the end of the shell located opposite this neck. The other shell has a cut out portion at one end for receiving the abutment. At its other end side is arranged a pin-like projection which is received in a correspondingly constructed slot provided in the neck having the thread. The cable bushing screwed onto the thread engages in a positive locking manner over this slot and the projection received by the latter. The shells forming the plug housing are accordingly secured relative to one another.

13 Claims, 2 Drawing Sheets

13
11
10
16
16
4
8
5
18
20
22
19
21
17
S
23
35
27
25
C
32
26
28
30
36
24
29
33
34
31

JACK PLUG

BACKGROUND OF THE INVENTION a) Field of the Invention

The invention is directed to a jack plug with a plug housing formed by two shells and a cable bushing which can be screwed onto a thread provided at the plug housing and penetrated by the cable to be connected.

b) Description of the Related Art

A jack plug of this constructional type is known (U.S. Pat. Nos. 5,180,317 and 5,261,839). In this previously known construction, a cylindrical groove is formed on each of the two shells forming the connector housing. When the shells are assembled, these two cylindrical grooves form a cylindrical member having an external thread on which a cable bushing can be screwed. One shell has, at one end, pins and bore holes whose axes extend at right angles to the dividing plane of the housing and which engage in one another when the shells are assembled so as to position the latter. Further, a longitudinal contact lug with crimpable plates is formed on the inside of the shell having the contact shafts. These crimpable plates serve to produce the ground connection of the connected cable. This construction is not advisable since the two shells forming the plug housing are only inadequately secured due to the fact that the above-mentioned bore holes and pins used for positioning can only secure the two shells with respect to possible displacement in the dividing plane of the housing, but can not absorb forces acting at right angles to the dividing plane of the housing. Also, a special tool is required for connecting the ground conductor of the cable.

OBJECT AND SUMMARY OF THE INVENTION

The primary object of the present invention is to provide an improved construction of a jack plug of the type mentioned above and further to design it so as to facilitate assembly. This object is met according to the invention in that the plug has a cylindrical neck which is substantially closed circumferentially and has a thread which is provided at the end of one shell. The other shell having a pin-like projection at its corresponding end side. This projection is received in a correspondingly constructed slot provided in the neck having the thread. The locking members which engage with one another in a positive engagement and secure the shells in their dividing plane and at an angle thereto are provided at the other end sides of the two shells. The cable bushing screwed onto the thread engages in a positive locking manner over the slot and the projection received in the latter, so that the shells forming the plug housing are secured relative to one another by the locking members on one side and by the positive-locking projection on the other side.

In order to illustrate the invention, an embodiment example of a jack plug will be explained more fully with reference to the drawings, but without thereby limiting the invention to the embodiment example illustrated here.

DESCRIPTION OF THE PREFERRED EMBODIMENTS

Figure 1:
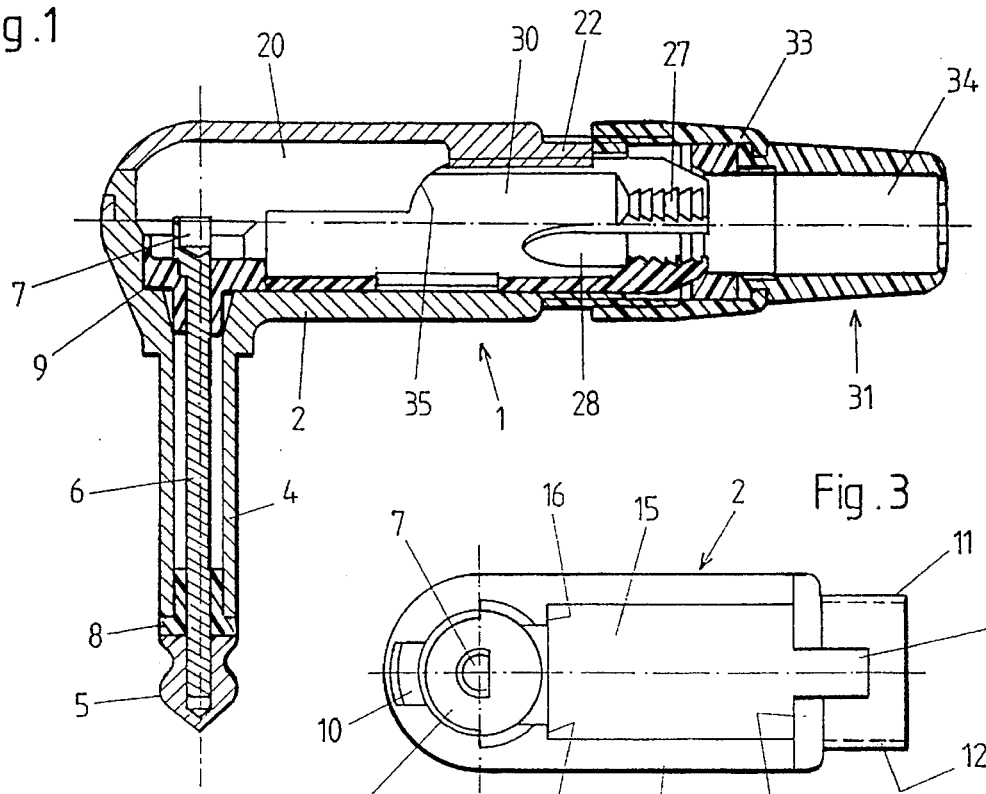
FIG. 1 shows a longitudinal section through the jack plug according to the invention.
Figure 3:
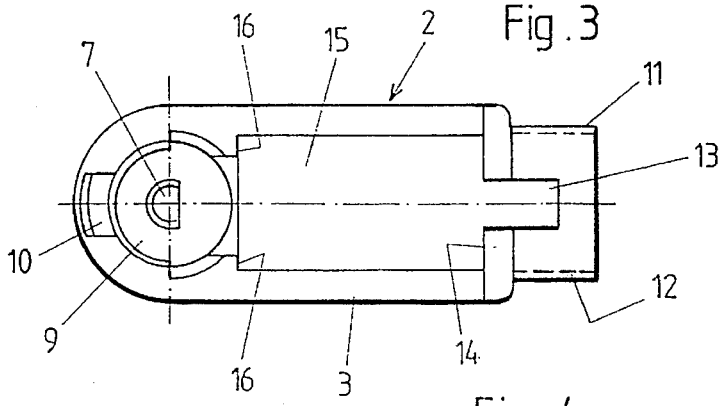
FIG. 3 is a top view thereof.
Figure 2:
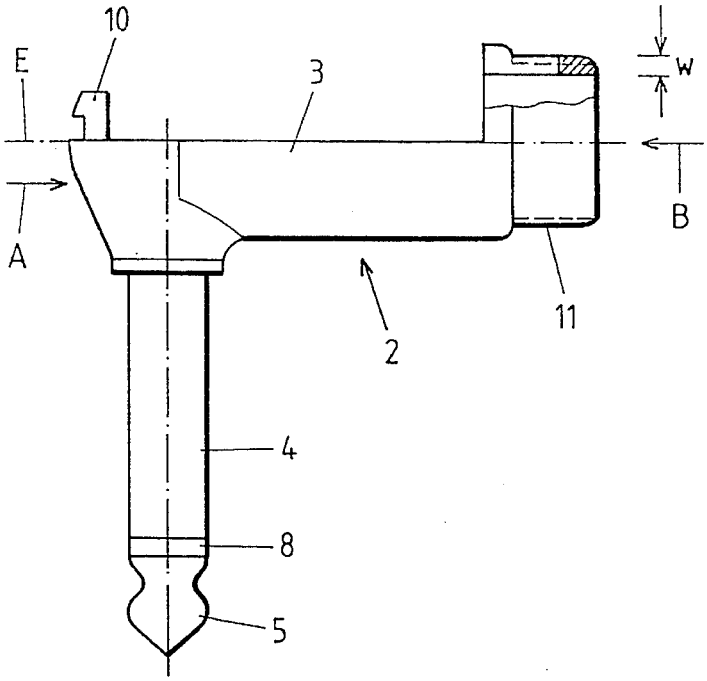
FIG. 2 is a plan view of one shell.
Figure 4:
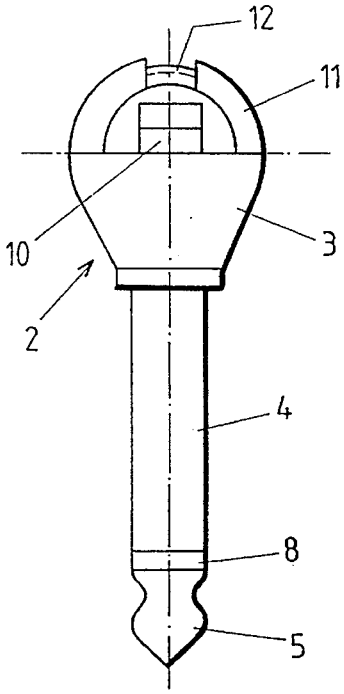
FIG. 4 shows a side view of this shell (as seen in the direction of arrow A in FIG. 2)

The jack plug according to FIG. 1, which is constructed as an angle connector, has a plug housing 1 formed by two shells 2 and 20. One shell 2 which is advisably produced from metallic material by diecasting technique has a groove-shaped portion 3, the outer contact shaft 4 being formed on integral therewith at one end. The contact of this angle plug is constructed as is conventional: the contact bulb or tip 5 is connected with a contact pin 6 which ends in a connection piece 7 inside the plug housing, the central conductor of the cable to be connected being secured at this connection piece 7. Insulating inserts 8 and 9 hold the contact tip 5 and its contact pin 6 in the provided position. A hook-like abutment 10 is formed integral with the front side of the shell 2 adjoining the outer contact shaft 4. The other end side of the shell 2 has a cylindrical neck 11 with an external thread 12. A slot 13 is cut out of this thread 12, or out of the neck 11 carrying this thread, proceeding from the housing side 14 of the cylindrical neck 11 (FIG. 3). The inner wall 15 of the shell 2 is delimited cylindrically at the front adjacent to the insulating insert 9 by projecting stops 16. The axis of the outer contact shaft 4 is situated at right angles to the dividing plane E (FIG. 2) of the plug housing 1.

Figures 5, 6, 7, 8, 9, 10, 11, 12:
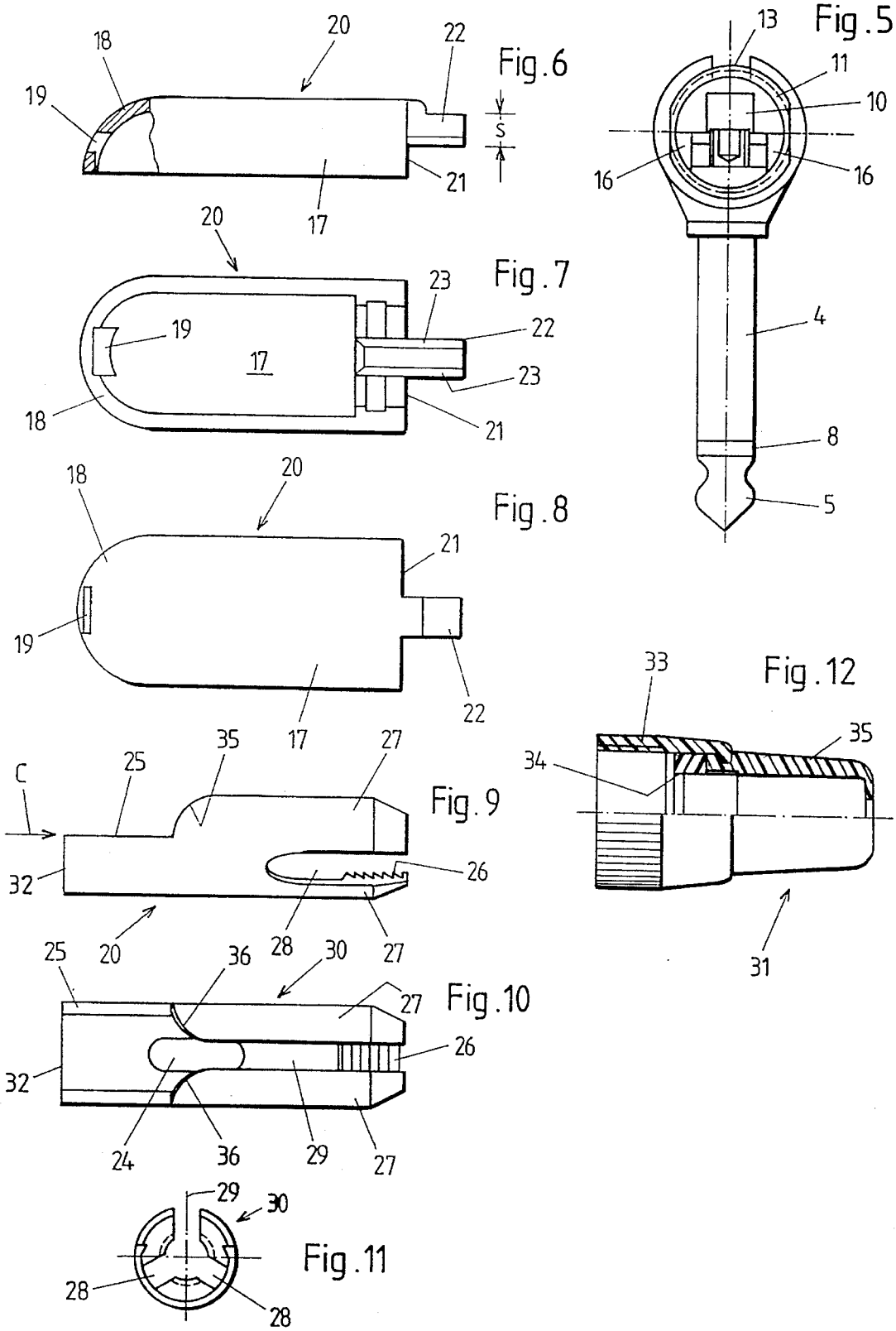
FIG. 5 shows a second side view of the shell according to FIG. 2 (as seen in the direction of arrow B in FIG. 2)
FIG. 6 shows a plan view of the second shell, partially cut away.
FIG. 7 is a bottom view thereof.
FIG. 8 is a top view thereof.
FIG. 9 shows a plan view of the clamping collet.
FIG. 10 shows a top view thereof.
FIG. 11 shows a side view thereof (as seen in the direction of arrow C in FIG. 9)
FIG. 12 shows a side view of the cable bushing in partial section.

The second shell 20 of the plug housing 1 shown in several views in FIGS. 6, 7 and 8 is advisably formed of plastic. It has a groove-like main portion 17 which is closed on one side by a semispherical shell 18 with a cut out portion 19. A pin-like projection 22 whose thickness s is somewhat greater than the wall thickness w of the cylindrical neck 11 with the external thread 12 is formed integral with the other end side 21 which is likewise closed. The longitudinal side cheeks 23 of the pin-like projection 22 are beveled somewhat and converge toward the bottom in a wedge-shaped manner.

Another structural component part of the jack plug is the clamping collet 30 which is manufactured from insulating plastic. This clamping collet 30 has a longitudinal slot 29. At the end of the clamping collet 30 to be received by the cable bushing 31, this clamping collet 30 is beveled conically at the outside and divided into springing plates 27 by a plurality of axially parallel notches 28 proceeding from the end mentioned above. These plates 27 can be provided with ribbing 26 internally. The portion of the clamping collet 30 received by the plug housing is stepped (FIGS. 9 and 10), the axially parallel longitudinal slot 29 extending in the shorter part of the clamping collet 30. The clamping collet 30 is symmetrically formed with respect to an imaginary longitudinal center plane containing its longitudinal axis and the longitudinal slot 29. The stepped portion 25 of the clamping collet 30 extends along roughly one third of its length. An imaginary plane containing the stepped portion 25 extends approximately through the longitudinal center axis of the clamping collet 30. A slot 24 is cut out of the wall of the clamping collet 30 located opposite the longitudinal slot 29. This slot 24 is advisably closed circumferentially as can be seen from FIG. 10. The inner end side 32 of the clamping collet 30 contacts the shell 2 of the plug housing 1 receiving it at stops 16.

Finally, the cable bushing 31 has a screwing part 33 formed of resistant sturdy material and an elastic part 35. An internal annular shoulder 34 cooperates with the beveled end of the clamping collet 30.

The parts described above are assembled as shown in the longitudinal section in FIG. 1. To assemble, the cable to be connected (not shown) is first inserted through the cable bushing 31 into the clamping collet 30 via the longitudinal slot 29. This insertion is facilitated by the rounded edges 36 of the stepped portion 25. After removing the insulation from the end region of the conductor, the cable with this conductor is inserted through the cylindrical neck 11 by this conductor portion, the exposed shielded conductor having been first inserted through the slot 24 and bent back. The clamping collet 30 with the inserted cable is now located in the shell 2 and the center conductor of the cable to be connected is secured to the connection piece 7, the clamping collet 30 contacting the stops 16 by its inner end side 32. The cut out portion 19 of the shell 20 is then hooked onto the hook-like abutment 10 and the shell 20 is swiveled relative to the first shell 2 so that the projection 22 comes to rest in the slot 13 of the cylindrical neck 11. In so doing, the projection 22 engages in the longitudinal slot 29 of the clamping collet 30 and the side cheeks of the projection 22 which converge at the bottom facilitates this insertion into this longitudinal slot 29. The cable bushing 31 is then screwed onto the thread 11, the screwing part 33 engaging over the projection 22 situated within the slot 13 so that the two shells 2 and 20 are secured relative to one another. At the same time, the annular shoulder 34 runs along the inside of the cable bushing 31 at the beveled end of the clamping collet 30 projecting opposite the thread 12 and cylindrical neck 11 and presses the springing plates 27 against the surface of the cable (not shown), thus forming the required pull protection.

Modifications are possible within the scope of the subject invention. If the neck 11 with the thread 12 is formed integral with the shell having the contact shafts and contact pins in the described embodiment example, it is conceivable in principle to form this cylindrical neck 11 with thread 12 so as to be integral with the attachable shell 20 and to provide the projection 22 at the shell 2 instead, so that the arrangement of the structural component parts serving to lock the two shells is reversed with respect to the shells. A positive-locking engagement other than the hook-like abutment 10 provided here is also possible, e.g., by means of a projecting or protruding edge at the rim of the semispherical shell 18 which would be received by a groove provided in shell 2. In all cases, the positive-locking connection is designed in such a way that the two shells 2 and 20 are secured relative to one another not only in their dividing plane, but also relative to the influence of forces acting at an angle to the dividing plane E.

While the foregoing description and drawings represent the preferred embodiments of the present invention, it will be obvious to those skilled in the art that various changes and modifications may be made therein without departing from the true spirit and scope of the present invention.

Reference Numbers:

| | |
|---|---|
| 1 plug housing | 30 clamping collet |
| 2 first shell | 31 cable bushing |
| 3 groove-shaped portion | 32 inner end side |
| 4 outer contact shaft | 33 screwing part |
| 5 contact tip | 34 shoulder |
| 6 contact pin | 35 elastic part |
| 7 connection piece | 36 rounded edge |
| 8 insulating insert | |
| 9 insulating insert | |
| 10 hook-shaped abutment | |
| 11 cylindrical neck | |
| 12 thread | |
| 13 slot | |
| 14 housing side | |
| 15 inner wall | |
| 16 stop | |
| 17 groove-like main portion | |
| 18 semispherical shell | |
| 19 cut out portion | |
| 20 second shell | |
| 21 end side | |
| 22 pin-like projection | |
| 23 side cheeks | |
| 24 slot | |
| 25 stepped portion | |
| 26 ribbing | |
| 27 plate | |
| 28 notch | |
| 29 longitudinal slot | |

What is claimed is:

1. In a jack plug with a plug housing formed by two shells and a cable bushing which can be screwed on a thread provided at the plug housing and penetrated by the cable to be connected, an outer contact shaft being formed integral with one shell of the plug housing, which shell is formed of metallic material, and said two shells forming the plug housing adapted to being fastened to one another by the screwed-on cable bushing, and the outer contact shaft or its longitudinal axis being disposed at right angles to a dividing plane of the plug housing, the improvement comprising:

a cylindrical neck which is substantially closed circumferentially and has a thread is provided at the end of one shell, the other shell having a pin-like projection at its corresponding end side;

said projection being received in a correspondingly constructed slot provided in the neck having the thread; and locking members which engage with one another in a positive engagement and secure the shells in their dividing plane and at an angle thereto being provided at the other end sides of the two shells;

wherein the cable bushing screwed onto the thread engages in a positive locking manner over the slot and the projection received in the latter, so that the shells forming the plug housing are secured relative to one another by the locking members on one side and by the positive-locking projection on the other side.

2. The jack plug according to claim 1, wherein the inner walls of the two shells forming the plug housing define a substantially cylindrical hollow space and wherein this cylindrical hollow space receives a clamping collet penetrated by the cable to be connected.

3. The jack plug according to claim 2, wherein the clamping collet has a longitudinal slot.

4. The jack plug according to claim 2, wherein the clamping collet is beveled conically at the outside at the end received by the cable bushing and is divided into springing plates by a plurality of axially parallel notches proceeding from said mentioned end and the conically beveled portion projects outward relative to the thread.

5. The jack plug according to claim 2, wherein the portion of the clamping collet situated in the plug housing is stepped and the axially parallel longitudinal slot is located in the shorter portion of the clamping collet.

6. The jack plug according to claim 2, wherein the clamping collet is symmetrically formed with respect to an imaginary longitudinal center plane containing its longitudinal axis and the longitudinal slot.

7. The jack plug according to claim 5, wherein the stepped portion of the clamping collet extends along roughly one third of its length.

8. The jack plug according to claim 5, wherein an imaginary plane containing the stepped portion extends at least approximately through the longitudinal center axis of the clamping collet.

9. The jack plug according to claim 3, wherein a slot is cut out of the wall of the clamping collet located opposite the longitudinal slot.

10. The jack plug according to claim 2, wherein an inner end side of the clamping collet contacts stops provided in the shell of the plug housing receiving it.

11. The jack plug according to claim 1, wherein the thickness of the pin-like projection at one shell is greater than the wall thickness of the cylindrical neck having the thread and this inwardly projecting portion of the projection is received by the longitudinal slot of the clamping collet.

12. The jack plug according to claim 1, wherein the side cheeks of the projection converge toward the bottom in a wedge-shaped manner.

13. The jack plug according to claim 1, wherein a hook-like abutment is formed integral with the front side of the shell as locking member, and the other shell has a cut out portion at its corresponding end side which receives this hook-like abutment, or vice versa.

* * * * *